US006926182B2

(12) United States Patent
Cragg

(10) Patent No.: US 6,926,182 B2
(45) Date of Patent: Aug. 9, 2005

(54) TASER HOLSTER

(76) Inventor: James Victor Cragg, 8515 Washington Blvd., Culver City, CA (US) 90232

( * ) Notice: Subject to any disclaimer, the term of this patent is extended or adjusted under 35 U.S.C. 154(b) by 0 days.

(21) Appl. No.: 10/648,112

(22) Filed: Aug. 25, 2003

(65) Prior Publication Data

US 2004/0112932 A1 Jun. 17, 2004

Related U.S. Application Data

(62) Division of application No. 09/991,425, filed on Nov. 16, 2001, now Pat. No. 6,691,906.

(51) Int. Cl.[7] ..... F41C 33/02

(52) U.S. Cl. ..... 224/238; 224/236; 224/240; 224/677; 224/901.4; 224/901.6; 224/911

(58) Field of Search ..... 224/192, 236, 224/238, 240, 675, 677, 681, 901.4, 901.6, 911, 914

(56) References Cited

U.S. PATENT DOCUMENTS 2,951,622 A * 9/1960 Heim ..... 224/192
3,762,616 A * 10/1973 Brunstetter ..... 224/677
3,949,916 A * 4/1976 Yount ..... 224/675
4,047,650 A * 9/1977 Domingos ..... 224/236
4,898,310 A * 2/1990 Remington ..... 224/238
5,395,023 A * 3/1995 Naymark et al. ..... 224/901.6
5,586,701 A * 12/1996 Kim ..... 224/236
5,779,122 A * 7/1998 Martinelli ..... 224/236
6,691,906 B2 * 2/2004 Cragg ..... 224/238

* cited by examiner

*Primary Examiner*—Gary E. Elkins
(74) *Attorney, Agent, or Firm*—Raymond Y. Chan; David and Raymond

(57) ABSTRACT

A taser holster includes a carrier for detachably fastening on a user's body, a pouch panel overlappedly provided on the carrier and defining a storage compartment, having a top opening, between the carrier and the pouch panel for receiving a taser, and a shielding flap, having a predetermined size and shape, overlappedly extended from the carrier for selectively folding from a closed position to an opened position. In the closed position, the shielding flap is folded to enclose the top opening of the storage compartment so as to cover a butt of the taser for protection purpose. In the opened position, the shielding flap is held by the carrier, which allows the taser withdrawing from the storage compartment efficiently.

17 Claims, 4 Drawing Sheets

TASER HOLSTER

CROSS REFERENCE OF RELATED APPLICATION

This is a divisional application of a non-provisional application, application Ser. No. 09/991,425, filed Nov. 16, 2001 now U.S. Pat. No. 6,691,906.

BACKGROUND OF THE PRESENT INVENTION

1. Field of Invention

The present invention relates to a holster, and more particularly to a taser holster which comprises a shielding flap not only adapted to cover up the taser holder for protecting the taser therein from public sight, damaging abrasions, and close quarters grappling, but also can be held over the taser holder such that the user is able to withdraw the taser from the taser holder in a quick and hassle-free manner.

2. Description of Related Arts

The duty of a police officer is to keep the public order. During the protest movement, such as protest march and demonstration, the police officers must be on alert and usually be armed to prevent an unexpected incident since any one of the demonstrators can be a potential offender. In order to minimize an unwanted injury, the police officer may carry other kinds of weapons such as taser or stagger gun instead of a pistol.

The taser is normally held in a holster which is stored in the squad car such that the police officer can quickly load the taser within seconds during such urgent situation. Another essential purpose of the holster is that the holster needs to offer security and conceal the taser from agitated individuals while providing a quick withdraw manner of the taser from the holster for use.

A conventional holster comprises a pocket for receiving the taser therein and a holder belt for tightening the taser in the pocket. As the patrolman's belt is already cluttered, the holster needs to be versatile in its mounting systems and comfortable. Moreover, the gripping portion of the taser is exposed out of the pocket, which is obvious and easy to be damaged from abrasions. Thus, the holster also requires a more tactical draw.

SUMMARY OF THE PRESENT INVENTION

A main object of the present invention is to provide a taser holster which comprises a shielding flap to protect the taser therein from public sight, damaging abrasions, and close quarters grappling.

Another object of the present invention is to provide a taser holster which provides full flapped protection and retention for law enforcement use.

Another object of the present invention is to provide a taser holster wherein the shielding flap is arranged to be held in an opened position such that the shielding flap will not be interfered with the taser withdrawing action.

Another object of the present invention is to provide a taser holster which enables a quick attachment on the user's body and is easy to use.

Another object of the present invention is to provide a taser holster which is compact and convenience to carry by detachably fastening on the user's body such as thigh or chest.

Accordingly, in order to accomplish the above objects, the present invention provides a taser holster, which comprises:

a carrier for detachably fastening on a user's body;

a pouch panel which is overlappedly provided on the carrier and defines a storage compartment, having a top opening, between the carrier and the pouch panel for receiving a taser, wherein the storage compartment has a cross section area gradually reducing from a top portion to a bottom portion thereof; and a shielding flap, having a predetermined size and shape, overlappedly extended from the carrier for selectively folding from a closed position to an opened position, wherein in the closed position, the shielding flap is folded to enclose the top opening of the storage compartment so as to cover a butt of the taser, and in the opened position, the shielding flap is held by the carrier, which allows the taser withdrawing from the storage compartment.

DETAILED DESCRIPTION OF THE PREFERRED EMBODIMENT

Figure 1:
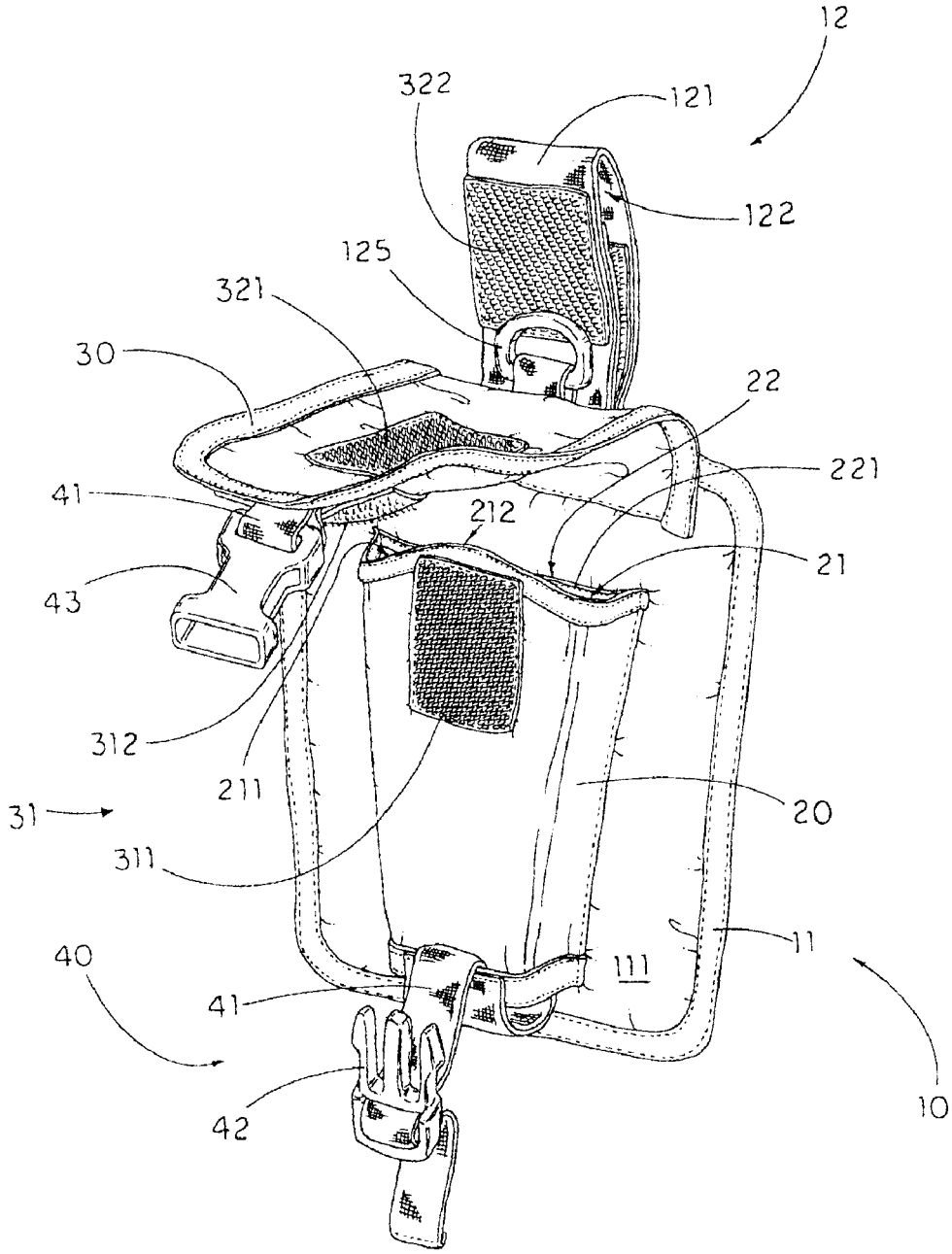
FIG. 1 is a front perspective view of a taser holster according to a preferred embodiment of the present invention.

Referring to FIG. 1 of the drawings, a taser holster according to a preferred embodiment of the present invention is illustrated, wherein the taser holster is adapted for offering security and concealing a taser T from agitated users. The taser holster comprises a carrier 10 for detachably fastening on a user's body, a pouch panel 20, and a shielding flap 30.

The pouch panel 20 is overlappedly provided on the carrier 10 and defines a storage compartment 21, having a top opening 211, between the carrier 10 and the pouch panel 20 for receiving the taser T.

Figure 2:
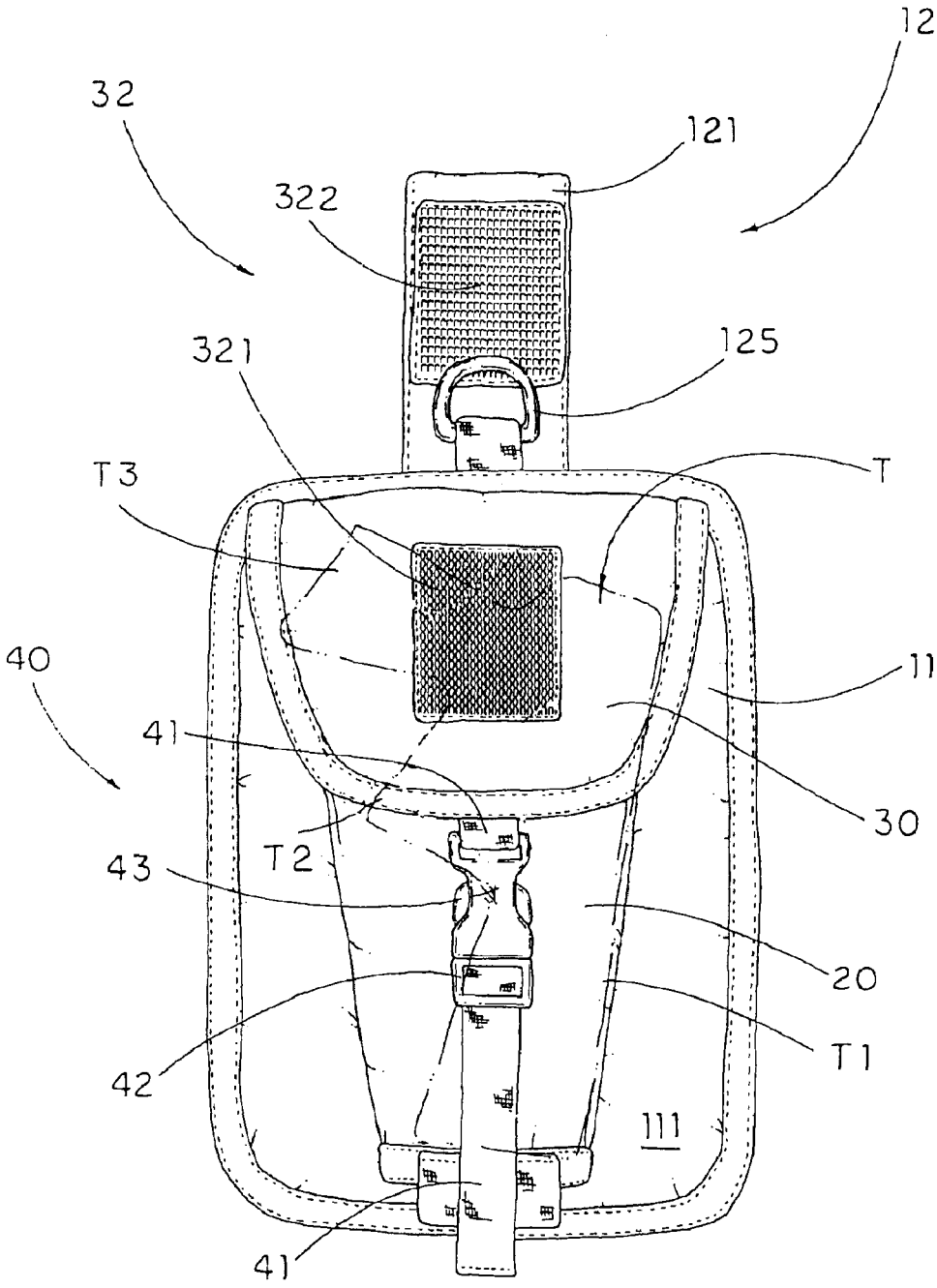
FIG. 2 is a front view of the taser holster in a closed position according to the above preferred embodiment of the present invention, illustrating the taser held by the taser holster.
Figure 3:
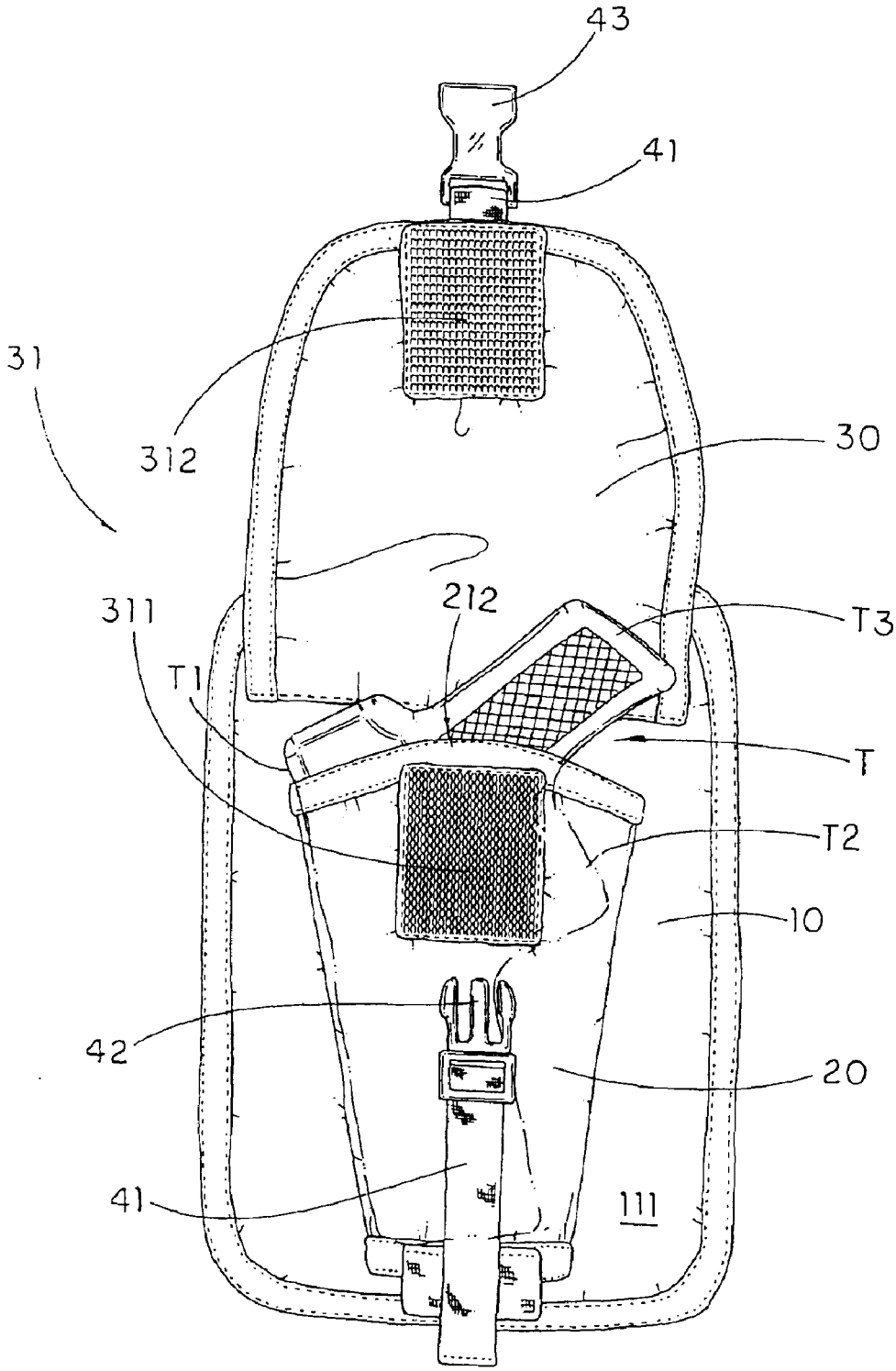
FIG. 3 is a front view of the taser holster in an opened position according to the above preferred embodiment of the present invention.

The shielding flap 30, having a predetermined size and shape, is overlappedly extended from the carrier 10 for selectively folding from a closed position to an opened position, wherein in the closed position as shown in FIG. 2, the shielding flap 30 is folded to enclose the top opening 211 of the storage compartment 21 so as to cover a butt of the taser, and in the opened position as shown in FIG. 3, the shielding flap 30 is held by the carrier 10, which allows the taser T withdrawing from the storage compartment 21.

According to the preferred embodiment, the carrier 10 comprises a pad body 11, having a front side 111 and a rear side 112, and a belt hanger 12 upwardly extended from a longitudinal edge of the pad body 11 and adapted for fastening on a waist position of the user. The pad body 11 is made of durable material such as nylon wherein a cushioned layer is provided between the front side 111 and the rear side 112 of the pad body 11 so as to provide a comfort touching when the pad body 11 is fastened on the user's body.

Accordingly, the belt hanger 12 comprises an elongated durable belt 121 having an affixing end affixed to the pad body 11 and a free end, wherein the belt hanger 12 is formed by folding the durable belt 121 overlappedly to form a hanging loop 122. A pair of fasteners 123, 124 are provided at the affixing end portion and the free end portion of the durable belt 121 such that the free end portion of the durable belt 121 is adapted to detachably attach to the affixing end portion thereof to form the hanging loop 122 by attaching the pair of fasteners 123, 124 with each other. Therefore, the user is able to hang the taser holster of the present invention at the waist portion by passing the user's waist belt through the hanging loop 122 of the belt hanger 12.

The belt hanger 12 further comprises a hanging ring 125 provided at a top longitudinal edge of the pad body 11 such that the taser holster can be detachably mounted on the user's uniform by detachably connecting the hanging ring 125 with a uniform buckle or waist belt provided on the user's uniform.

The pouch panel 20 has two side edges firmly affixed on the front side 111 of the pad body 11 by stitching to form the storage compartment 21 between the pouch panel 20 and the pad body 11 wherein the storage compartment 21 has a cross section area gradually reducing from a top portion to a bottom portion of the storage compartment 21, such that the storage compartment 21 is shaped and sized to fit the taser T receiving therein.

An opening edge of the top opening 211 of the storage compartment 21 is defined by a convex top edge 212 of the pouch panel 20 which has a curved shape gradually descending from a mid-portion of the top edge 212 to two side edges thereof, so as to enhance a retention of taser T in the storage compartment 21.

For left-hand user, the taser holster is preferred to be mounted to the left tight of the user. As shown in FIG. 3, the taser T is preferred to be retained in the storage compartment 21 in such a manner that the top edge T1 of the taser T is aligned with the inclined left side of the pouch panel 20, the trigger guard T2 is biased against the inclined right side of the pouch panel 20 and a taser handle pointing rightwardly. The upwardly and curvedly extended mid-portion of the top edge 212 substantially covers and holds more middle portion, including the safety switch, of the taser T in position.

Alternatively, as shown in FIG. 2 that illustrates the taser T being held in an opposite position, wherein for right-hand user, the taser T is preferred to be retained in the storage compartment 21 while the top edge T1 of the taser T is aligned with the inclined right side of the pouch panel 20, the trigger guard T2 is biased against the inclined left side of the pouch panel 20 and a taser handle pointing leftwardly. Therefore, the upwardly and curvedly extended mid-portion of the top edge 212 will still substantially cover and hold more middle portion, including the safety switch, of the taser T in position. In other words, the same taser holster of the present invention can be used for both the right-hand and left hand users.

The shielding flap 30 has a longitudinal edge affixed to the pad body 11 by stitching wherein the shielding flap 30 is adapted to overlappedly fold down to enclose the top opening 211 of the storage compartment 21 so as to cover on the pouch panel 20. Therefore, the shielding flap 30 can minimize the exposure of the taser T in public.

In order to securely hold the shielding flap 30 between the closed position and the opened position, a first pair of holding elements 31 is provided on the pouch panel 20 and the shielding flap 30 respectively and a second pair of holding elements 32 is provided on the shielding flap 30 and the belt hanger 12 respectively.

Accordingly, the first pair of holding elements 31 is a pair of hoop and loop fasteners 311, 312 provided on an outer side of the pouch panel 20 and an inner side of the shielding flap 30 in such a manner that the shielding flap 30 is adapted to securely enclose the storage compartment 21 in the closed position by detachably fastening the first pair of holding elements 31 together, as shown in FIG. 2.

The second pair of holding element 32 is a pair of hoop and loop fasteners 321, 322 provided on an outer side of the shielding flap 30 and an outer side of the belt hanger 12 in such a manner that the shielding flap 30 is adapted to fold upward and hold by the belt hanger 12 in the opened position by detachably fastening the second pair of holding element 31 together so as to communicate the storage compartment 21 with outside, as shown in FIG. 3. In other words, in the opened position, the shielding flap 30 is held by the carrier 10 such that the user is able to withdraw the taser T from the taser holster of the present invention efficiently without interfering by the shielding flap 30, especially when the user is in an alert situation.

As shown in FIG. 1, the taser holster further comprises a patch pocket 22, having a top opening, provided in the storage compartment 21 for placing accessories such as badge, license, or instruction, wherein the patch pocket 22 is formed by a pocket flap 221 affixed between the pouch panel 20 and the pad body 11 such that the patch pocket 221 is provided between the pocket flap 22 and the pad body 11.

The taser holster further comprises a securing unit 40 comprising a first and second securing straps 41 extended from the pouch panel 20 and the shielding flap 30 respectively, a buckle plug 42 provided at a free end of the first securing strap 41, and a corresponding buckle socket 43 provided at a free end of the second securing strap 41, so that the shielding flap 30 is further securely locked up at the closed position by detachably buckling up the buckle plug 42 and the buckle socket 43. Therefore, the securing unit 40 enhances the shielding flap 30 to protect the taser T from close quarters grappling. It is worth to mention that the buckle plug 42 and the buckle socket 43 can be replaced by other fasteners such as hoop and loop fasteners, snap fasteners, straps with cinch or such similar attachment for fastening two members together.

Figure 4:
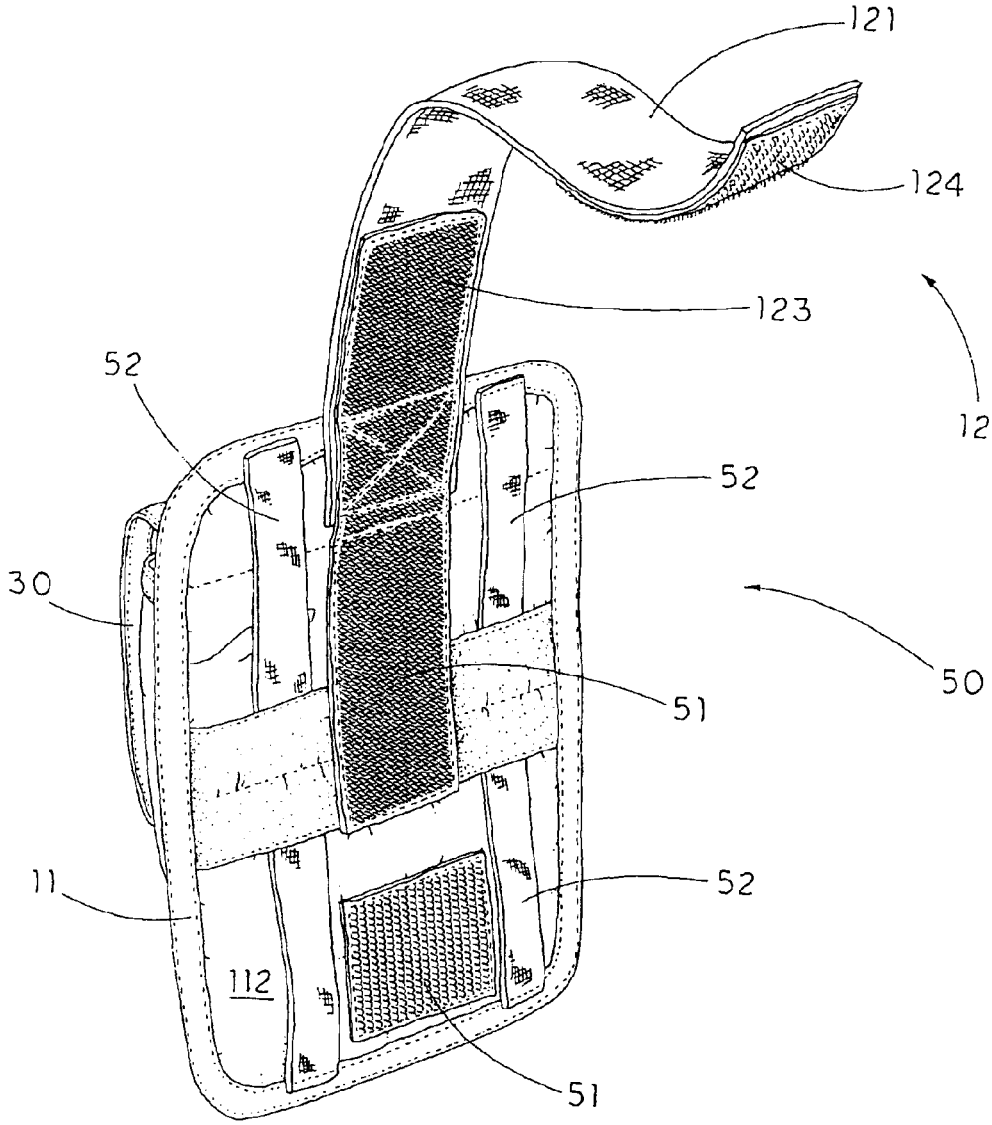
FIG. 4 is a rear perspective view of the taser holster according to the above preferred embodiment of the present invention.

As shown in FIG. 4, the taser holster further comprises an attaching unit 50 for detachably attaching the pad body 11 to the user's body, wherein the attaching unit 50 comprises at least a fastening element 51 provided on the rear side 112 of the pad body 11 for detachably attaching to the user's uniform. Accordingly, the fastening element 51 can be a hoop fastener, loop fastener, or both hoop and loop fasteners, as shown in FIG. 4, affixed to the rear side 112 of the pad body 11. The attaching unit 50 further comprises at least a fastening strap 52 having two ends affixed to the rear side 112 of the pad body 11 such that the user's uniform having a corresponding chest strap is adapted to fasten to the fastening strap 52 by passing the chest belt between the fastening strap 52 and the pad body 11. In other words, the taser holster of the present invention can be detachably mount on the user's chest or thigh position by fastening the attaching unit 50 to the corresponding fastening element or chest strap provided on the chest or thigh portion of the user's uniform.

In view of above, the taser holster of the present invention substantially achieves the following distinctive features:

(1) The shielding flap not only protects the taser therein from public sight, damaging abrasions and closes quarters grappling, but also provides full flapped protection and retention for law enforcement use.

(2) The shielding flap is arranged to be held in an opened position such that the shielding flap will not be interfered with the taser withdrawing action.

(3) The taser holster enables a quick attachment on the user's body and is easy to use.

(4) The taser holster is compact and convenience to carry by detachably fastening on the user's body such as thigh or chest.

(5) The taser holster can be used to store and carry other hand weapons such as a pistol or revolver.

What is claimed is:

1. A taser holster, which comprises:

a carrier for detachably fastening on a user's body;

a pouch panel which is overlappedly provided on said carrier and defines a storage compartment, having a top opening, between said carrier and said pouch panel for receiving a taser in said storage compartment;

a shielding flap, having a predetermined size and shape, overlappedly extended from said carrier for selectively folding from a closed position to an opened position; and a holding device comprising first hook and loop fasteners provided on an outer side of said pouch panel and an inner side of said shielding flap respectively to retain said shielding flap at said closed position and second hook and loop fasteners provided on said carrier and an outer side of said shielding flap respectively to retain said shielding flap at said open position, wherein in said closed position, said first hook fastener is detachably fastened with said first loop fastener to securely attach said shielding flap to said pouch panel to enclose said top opening of said storage compartment for covering a butt of said taser so as to securely retain said taser in said storage compartment, and at said opened position, said second fastener is detachably fastened with said second loop fastener to attach said shielding flap to said carrier for said taser being ready to quickly withdraw from said storage compartment without being interfered by said shielding flap.

2. The taser holster, as recited in claim 1, wherein said pouch panel has a curved top edge gradually increasing a height to a mid-portion thereof, wherein said pouch panel is adapted for holding said taser in said storage compartment at a predetermined position for either a right-hand user or a left-hand user to quickly withdraw said taser.

3. The taser holster, as recited in claim 1, wherein said carrier comprises a pad body that said pouch panel is overlapped thereon to form said storage compartment between said pad body and said pouch panel, and a belt hanger upwardly extended from said pad body for detachably fastening on a waist position of said user.

4. The taser holster, as recited in claim 2, wherein said carrier comprises a pad body that said pouch panel is overlapped thereon to form said storage compartment between said pad body and said pouch panel, and a belt hanger upwardly extended from said pad body for detachably fastening on a waist position of said user.

5. The taser holster, as recited in claim 3, wherein said belt hanger comprises an elongated durable belt having an affixing end affixed to said pad body and a free end detachably fastened at a portion of said durable belt to form a hanging loop for a waist belt of said user passing therethrough.

6. The taser holster, as recited in claim 4, wherein said belt hanger comprises an elongated durable belt having an affixing end affixed to said pad body and a free end detachably fastened at a portion of said durable belt to form a hanging loop for a waist belt of said user passing therethrough.

7. The taser holster, as recited in claim 4, further comprising an attaching unit which comprises at least a fastening element provided on a rear side of said pad body for detachably attaching said pad body on a uniform of said pad user.

8. The taser holster, as recited in claim 6, further comprising an attaching unit which comprises at least a fastening element provided on a rear side of said pad body for detachably attaching said pad body on a uniform of said user.

9. The taser holster, as recited in claim 1, further comprising a securing unit which comprises first and second securing straps extended from said pouch panel and said shielding flap respectively, a buckle plug provided at a free end of said first securing strap, and a corresponding buckle socket provided at a free end of said second securing strap, wherein said buckle plug is detachably fastened with said buckle socket to securely lock up said shielding flap at said closed position for protecting said taser from close quarters grappling.

10. The taser holster, as recited in claim 2, further comprising a securing unit which comprises first and second securing straps extended from said pouch panel and said shielding flap respectively, a buckle plug provided at a free end of said first securing strap, and a corresponding buckle socket provided at a free end of said second securing strap, wherein said buckle plug is detachably fastened with said buckle socket to securely lock up said shielding flap at said closed position for protecting said taser from close quarters grappling.

11. The taser holster, as recited in claim 4, further comprising a securing unit which comprises first and second securing straps extended from said pouch panel and said shielding flap respectively, a buckle plug provided at a free end of said first securing strap, and a corresponding buckle socket provided at a free end of said second securing strap, wherein said buckle plug is detachably fastened with said buckle socket to securely lock up said shielding flap at said closed position for protecting said taser from close quarters grappling.

12. The taser holster, as recited in claim 6, further comprising a securing unit which comprises first and second securing straps extended from said pouch panel and said shielding flap respectively, a buckle plug provided at a free end of said first securing strap, and a corresponding buckle socket provided at a free end of said second securing strap, wherein said buckle plug is detachably fastened with said buckle socket to securely lock up said shielding flap at said closed position for protecting said taser from close quarters grappling.

13. The taser holster, as recited in claim 8, further comprising a securing unit which comprises first and second securing straps extended from said pouch panel and said shielding flap respectively, a buckle plug provided at a free end of said first securing strap, and a corresponding buckle socket provided at a free end of said second securing strap, wherein said buckle plug is detachably fastened with said buckle socket to securely lock up said shielding flap at said closed position for protecting said taser from close quarters grappling.

14. The taser holster, as recited in claim 4, further comprising a pocket flap overlapped between said pouch panel and said pad body to form a patch pocket, having a top open, provided in said storage compartment for placing accessories.

15. The taser holster, as recited in claim 8, further comprising a pocket flap overlapped between said pouch panel and said pad body to form a patch pocket, having a top open, provided in said storage compartment for placing accessories.

16. The taser holster, as recited in claim 11, further comprising a pocket flap overlapped between said pouch panel and said pad body to form a patch pocket, having a top open, provided in said storage compartment for placing accessories.

17. The taser holster, as recited in claim 13, further comprising a pocket flap overlapped between said pouch panel and said pad body to form a patch pocket, having a top open, provided in said storage compartment for placing accessories.

* * * * *